US006646855B2

(12) United States Patent
Buening et al.

(10) Patent No.: US 6,646,855 B2
(45) Date of Patent: Nov. 11, 2003

(54) STUN GLOVE

(76) Inventors: Dennis J. Buening, 46151 Bloomcrest Dr., Northville, MI (US) 48167; Gudni H. Gudnason, 773 E. 675 South, Brigham City, UT (US) 84302

( * ) Notice: Subject to any disclaimer, the term of this patent is extended or adjusted under 35 U.S.C. 154(b) by 86 days.

(21) Appl. No.: 10/051,223

(22) Filed: Jan. 18, 2002

(65) Prior Publication Data

US 2003/0137795 A1 Jul. 24, 2003

(51) Int. Cl.[7] ..... H01T 23/00; A41D 19/00

(52) U.S. Cl. ..... 361/232; 361/230; 2/160; 42/1.08

(58) Field of Search ..... 42/1.08; 2/159–160; 472/56; 361/253–263, 230, 232

(56) References Cited

U.S. PATENT DOCUMENTS

| | | | | |
|---|---|---|---|---|
| 1,046,985 A | | 12/1912 | Creedon | |
| 1,915,721 A | | 6/1933 | Diaz | |
| 3,556,105 A | | 1/1971 | Shepard | |
| 3,845,771 A | | 11/1974 | Vise | |
| 4,207,904 A | | 6/1980 | Greene | |
| 4,242,715 A | | 12/1980 | Laird | |
| 4,370,696 A | | 1/1983 | Darrell | |
| 4,485,426 A | | 11/1984 | Keris | |
| 4,510,939 A | | 4/1985 | Brenman | |
| 4,947,486 A | * | 8/1990 | Hsuih | 2/164 |
| 5,067,478 A | | 11/1991 | Berlant | |
| 5,282,481 A | | 2/1994 | Ziemer | |
| 5,289,164 A | | 2/1994 | Novak | |
| D364,208 S | * | 11/1995 | Larson | D22/117 |

* cited by examiner

*Primary Examiner*—Dean A. Reichard
*Assistant Examiner*—Eric Thomas
(74) *Attorney, Agent, or Firm*—Robert Kelley Roth; Miller, Canfield, Paddock & Stone PLC

(57) ABSTRACT

A stun glove for directing an electric shock to an assailant includes a power source, an insulator shaped to receive a hand, having a back corresponding to a back side of the hand and a front corresponding to a front side of the hand, a first terminal spaced apart from a second terminal, with both terminals positioned on the back of the insulator and extending generally perpendicular from the back, and a stun contact positioned on the back of the insulator and extending generally perpendicular from the back, and having an open position and a closed position, wherein in the closed position the power source is in electrical communication with the terminals, allowing a spark to jump between the terminals. A warning contact may optionally be provided which could be actuated to produce a warning spark across the terminals.

15 Claims, 2 Drawing Sheets

STUN GLOVE

FIELD OF THE INVENTION

This invention relates to improved defensive, non-lethal weaponry and, more particularly, to a device for delivering an electric shock to stun an assailant.

BACKGROUND OF THE INVENTION

Stun guns are legal devices that allow their operator to produce a high voltage, low amperage shock to shock or impair movement of an assailant. The shock effect is highly localized so that the assailant cannot readily return the shock to the operator of the stun gun if the assailant is holding the operator. The shock has the effect of interrupting voluntary muscle movement and thought, and at higher voltages can result in loss of consciousness.

A stun glove is a device which incorporates the shock feature of a stun gun into a glove. Such gloves can be used by law enforcement and security personnel to subdue assailants. They may also be used to control mentally ill patients or to control potentially violent animals.

U.S. Pat. No. 5,282,481 discloses a shocking device with shock probes attached to the top of the fist and extending parallel to the back of the hand. This design would have problems with bulk, preventing a user from grasping an object while operating the shock device. Also, since the shock probes overhang the knuckles of the user's fist, the high voltages generated between the shock probes (possibly as high as 300,000–500,000 Volts) could lead to arcing with the user's fingers instead of an assailant. Thus, bulky insulation would be required for practical and applications.

Accordingly, it would be desirable to have a stun glove sufficiently flexible to allow an operator to hold another object such a baton, a gun, or other weapon while still protecting the operator from shocking himself during operation. It would also be desirable to have a stun glove which is highly durable in operation.

SUMMARY OF THE INVENTION

In accordance with a first aspect, a stun glove has a power source, an insulator shaped to receive a hand, having a back corresponding to a back side of the hand and a front corresponding to a front side of the hand, a first terminal spaced apart from a second terminal, with both terminals positioned on the back of the insulator and extending generally perpendicular from the back, and a stun contact positioned on the back of the insulator and extending generally perpendicular from the back, and having an open position and a closed position. In the closed position the power source is in electrical communication with the terminals, allowing a spark to jump between the terminals.

In accordance with another aspect, a warning contact is provided to generate a spark visible to an assailant, indicating to the assailant that if he attacks he risks a severe shock.

Figure 1:
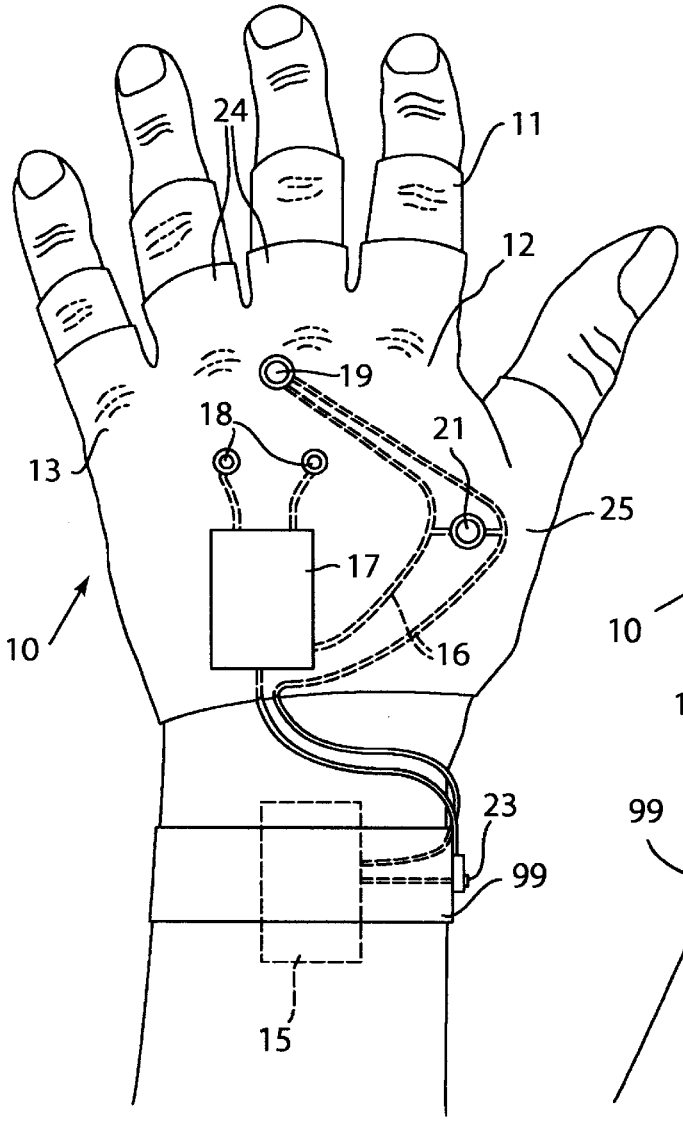
FIG. 1 is a view of the stun glove from the back side of a hand in accordance with a preferred embodiment.

It should be understood that the appended drawings are not necessarily to scale, presenting a somewhat simplified representation of various preferred features illustrative of the basic principles of the invention. The specific design features of the stun glove as disclosed here, including, for example, specific dimensions and location of. the terminals will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation of the stun glove illustrated in the drawings. In general, the directions correspond to the portions of a hand which the stun glove would fit into—back side of hand, front or palm side, finger portion, etc.

DETAILED DESCRIPTION OF CERTAIN PREFERRED EMBODIMENTS

It will be apparent to those skilled in the art, that is, to those who have knowledge or experience in this area of technology, that many uses and design variations are possible for the stun glove disclosed herein. The following detailed discussion of various alternative and preferred features and embodiments will illustrate the general principles of the invention with reference to a stun glove for use by security personnel. Other embodiments suitable for other applications will be apparent to those skilled in the art given the benefit of this disclosure.

Referring now to the drawings, FIG. 1 shows a stun glove 10 having an internal fabric 11 for comfort positioned around a hand. An insulator 12 extends around the internal fabric, and has a back portion 13 corresponding to the back of the hand, a front portion corresponding to the front or palm of the hand, a finger portion 24 extending at least somewhat towards the tips of the fingers from the knuckles of the hand, and a thumb portion 25 corresponding to the thumb of the hand. It will be readily apparent to those skilled in the art, given the benefit of this disclosure, that the finger portion 24 of the insulator may extend from the knuckles to around the tips of the fingers or, as shown in the drawings, the finger portion may be cut off to make it easier for an operator of the stun glove to feel and hold an object.

Figure 2:
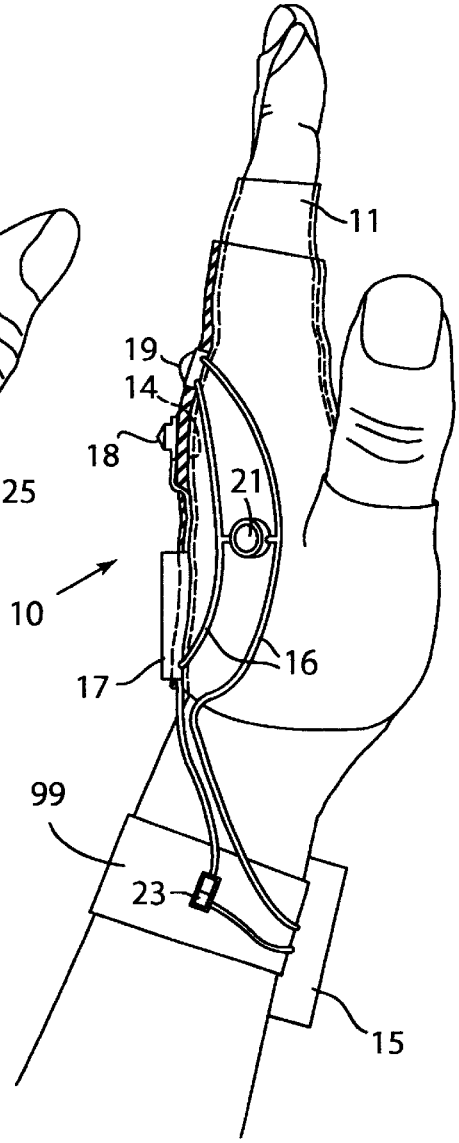
FIG. 2 is a side view of the stun glove of FIG. 2.

A power source 15 such as, for example, a 9 Volt battery may be mounted on the forearm via armband 99, along with a main power switch 23 connecting the power source to the remainder of the stun glove. A pair of terminals 18 are mounted on the back of the insulator 12, and are seen in FIG. 2 to extend generally perpendicular to the back 13 and at some distance from the end of the insulator, preferably at least 1–2 inches. Positioning the terminals generally perpendicular with the back also helps move the terminals away from the hand and reduce the potential for arcing to the operator's hand when a large voltage is applied across the terminals.

Wires 16 connect the terminals 18 to the power source 15. In certain preferred embodiments, the wires are in-molded with the insulator. Optionally stun contact 19 and warning contact 21 (discussed in detail below) may also be in-molded or formed into a modular subassembly with the insulator as well. A transformer 17 is positioned between the terminals 18 and the power source 15. The transformer is shown mounted on the insulator 12. Alternatively, if the transformer is too bulky it may be moved back to the forearm mount with the power supply 15 and the on/off switch 23. The transformer 17 is in electrical communication with the power supply and acts to significantly increase the voltage while decreasing the amperage of current at the terminals.

When the circuit formed by the power source and the terminals is closed, a large electrical potential difference is generated between the terminals, producing a spark. The voltage across the terminals can be as high as 300,000 to 500,000 Volts, for example, depending on the transformer used. Such high voltages are needed to subdue an attacker, as in the case where the stun glove has been deployed by security personnel or police in a riot. Because the voltages can be so high, and the terminals are in the proximity of the hand, the insulator 12 must be highly resistant to electricity. At the same time it is preferable that the stun glove be flexible enough to allow an operator to hold an additional object, such as a weapon. Many materials which are nominally known as insulating materials are unacceptable due to the high voltages and/or heat generated at the terminals. One suitable material satisfying these competing requirements of insulating properties and flexibility is a PVC based insulating plastic, such as >PVC (M+KD) 60<, which is mineral filled and has powdered calcium carbonate. Other suitable insulating plastics will be readily apparent to those skilled in the art given the benefit of this disclosure.

The spark cannot be generated until the circuit is closed, even with the master power switch 23 in the on position, until one of either a stun contact 19 or a warning contact 21 is moved from an open position to a closed position. FIG. 1 shows a stun contact 19 positioned on the back 13 closer to the finger portion 24 of the insulator than the terminals 18. Stun contact 19 may be, for example, a button biased by a spring to an open position. Generally the stun contact is positioned so that it would come into contact with the objected which the stun glove operator desires to have stunned. Pushing the stun contact against an assailant overcomes the force of the spring, moving the stun contact to the closed position, completing the circuit so that the spark is generated across the terminals 18.

Warning contact 21 is a second contact similar to the stun contact. Typically it would be positioned so that it could be contacted by the operator of the stun glove without shocking himself, either on the back of the hand or alternatively, at a position off the hand such as near the power source. Contacting the warning contact closed the circuit and generates a spark. Thus, the operator can demonstrate to an assailant the power to shock without actually shocking the assailant.

Figure 3:
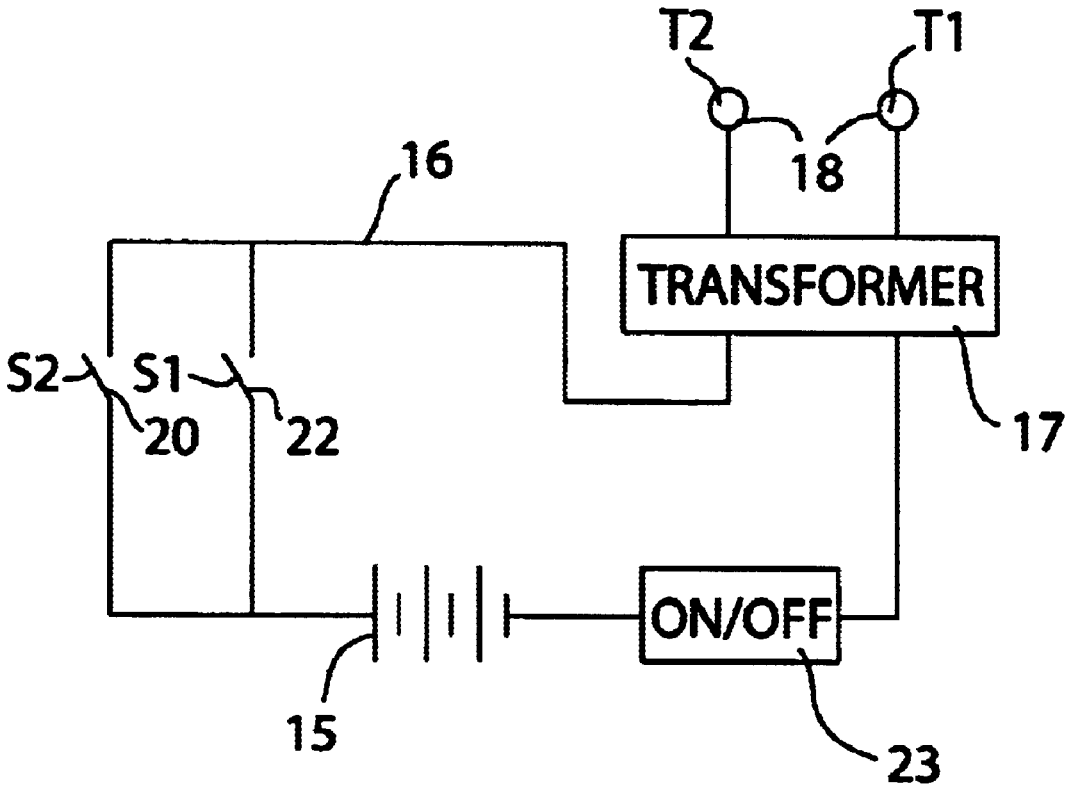
FIG. 3 is a circuit in accordance with a preferred embodiment, showing a switch corresponding to a stun contact and a second switch corresponding to a warning contact.

FIG. 3 is a circuit diagram which shows how the various components are electrically connected. Preferably the transformer is positioned so that the high voltage is only present at the terminals, and a lower voltage generally the same as the power supply 15 passes through the on/off switch 23 and the switches 20, 22 corresponding to the stun contact 19 and to the warning contact 21, respectively. Preferably the switches 20, 22 are aligned in parallel, so that when either one is in the closed position the circuit may be completed, allowing the spark to be generated.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A stun glove comprising, in combination:

a power source;

an insulator shaped to receive a hand, having a back corresponding to a back side of the hand and a front corresponding to a front side of the hand;

a first terminal spaced apart from a second terminal, with both terminals positioned on the back of the insulator and extending generally perpendicular from the back; and a stun contact positioned on the back of the insulator and extending generally perpendicular from the back, and having an open position and a closed position;

wherein in the closed position the power source is in electrical communication with the terminals, allowing a spark to jump between the terminals.

2. The stun glove of claim 1 further comprising a transformer in electrical communication with the power source, increasing the voltage between the terminals.

3. The stun glove of claim 2 wherein the transformer is positioned on the insulator.

4. The stun glove of claim 1 further comprising fabric received on the inside of the insulator.

5. The stun glove of claim 4 wherein the stun contact is positioned between the terminals and a finger portion of the insulator.

6. The stun glove of claim 1 wherein the power source is structured to be mounted on a forearm.

7. The stun glove of claim 1 wherein electrical wires connect the power source to the terminals, and are formed as in-molded components of the insulator.

8. The stun glove of claim 1 wherein the insulator has a finger portion corresponding to fingers on the hand and the stun contact is free of the finger portion.

9. A stun glove comprising, in combination:

a power source;

an insulator shaped to receive a hand, having a back corresponding to a back side of the hand, and a front corresponding to a front side of the hand;

a first terminal spaced apart from a second terminal, with both terminals positioned on the back of the insulator;

a stun contact positioned on the back of the insulator, having an open position and a closed position, wherein in the closed position the power source is in electrical communication with the terminals, allowing a spark to jump between the terminals; and a warning contact positioned remote from the stun contact, having an open position and a closed position, wherein in the closed position the power source is in electrical communication with the terminals, allowing a spark to jump between the terminals.

10. The stun glove of claim 9 further comprising a thumb portion of the insulator, wherein the warning contact is positioned on the thumb portion.

11. The stun glove of claim 9 wherein the stun contact and the warning contact are electrically connected in parallel.

12. A stun glove comprising, in combination:

a power source;

an insulator;

a first terminal spaced apart from a second terminal, with both terminals positioned on the insulator;

a stun contact, having an open position and a closed position, wherein in the closed position the power source is in electrical communication with the terminals, allowing a spark to jump between the terminals; and a warning contact having an open position and a closed position, wherein in the closed position the power source is in electrical communication with the terminals, allowing a spark to jump between the terminals;

wherein the stun contact and the warning contact are electrically connected in parallel.

13. The stun glove of claim 12 wherein the terminals are electrically isolated from the power source when both the stun contact and the warning contact are in the open position.

14. The stun glove of claim 12 wherein the insulator is a plastic containing PVC.

15. The stun glove of claim 14 wherein the plastic is >PVC (M+KD) 60<.

* * * * *